United States Patent [19]

Waldecker

[11] Patent Number: 4,824,282

[45] Date of Patent: Apr. 25, 1989

[54] METHODS AND APPARATUS FOR QUICKLY ERECTING A VEHICLE BARRIER ACROSS A ROADWAY

[76] Inventor: Donald E. Waldecker, 1000 Water St. SW., Washington, D.C. 20024

[21] Appl. No.: 117,948

[22] Filed: Nov. 6, 1987

[51] Int. Cl.[4] ..... E01F 13/00

[52] U.S. Cl. ..... 404/6; 49/9; 49/33; 49/34

[58] Field of Search ..... 404/6, 11; 49/9, 33, 49/34, 49, 131, 133; 256/13.1; 244/114 R; 188/32

[56] References Cited

U.S. PATENT DOCUMENTS

| | | | |
|---|---|---|---|
| 1,575,248 | 3/1926 | Andy | 52/2 |
| 1,692,142 | 11/1928 | Strauss | 49/9 |
| 1,848,517 | 3/1932 | Davison | 49/9 |
| 2,712,912 | 7/1955 | Hattan | 49/9 X |
| 2,783,957 | 3/1957 | O'Neil et al. | 244/110 C |
| 3,141,655 | 7/1964 | Platt | 256/1 |
| 3,197,628 | 7/1965 | Schuff | 52/2 |
| 3,753,317 | 8/1973 | Turpin et al. | 49/35 |
| 3,913,264 | 10/1975 | Kohen | 49/49 |
| 4,047,702 | 9/1977 | Cernia et al. | 256/13.1 |
| 4,099,759 | 7/1978 | Kornhauser | 267/116 X |
| 4,176,858 | 12/1979 | Kornhauser | 280/734 |
| 4,198,036 | 4/1980 | O'Neal | 188/32 X |
| 4,290,585 | 9/1981 | Glaesener | 256/13.1 |
| 4,293,969 | 10/1981 | Frommelt | 52/2 |
| 4,298,214 | 11/1981 | Brown, Jr. | 280/735 |
| 4,576,507 | 3/1986 | Terio | 404/6 |

*Primary Examiner*—Jerome W. Massie, IV
*Assistant Examiner*—Matthew Smith
*Attorney, Agent, or Firm*—Burns, Doane, Swecker & Mathis

[57] ABSTRACT

A barrier system is provided for blocking a roadway to prevent passage of a vehicle. The barrier system comprises a series of inflatable bags connected to a flexible net, and energy dissipating units connected to ends of the net. The system is normally located in a subterranean chamber when deactivated. When activated, the air bags are inflated and rise above the ground surface while pulling the net upwardly therewith. A vehicle which impacts the barrier is rapidly decelerated under the energy dissipating action of the air bags, energy dissipating units, and net.

14 Claims, 6 Drawing Sheets

Fig. 8
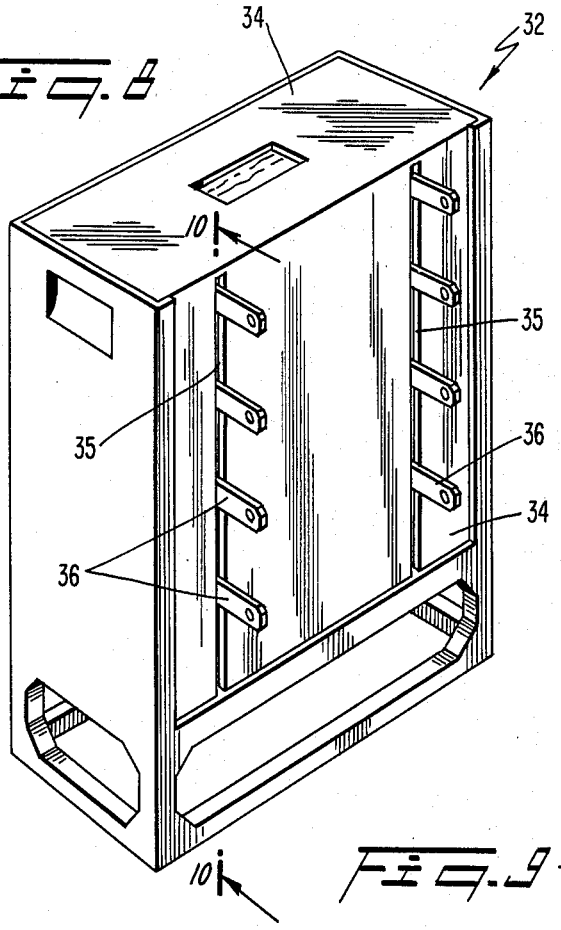
Fig. 9
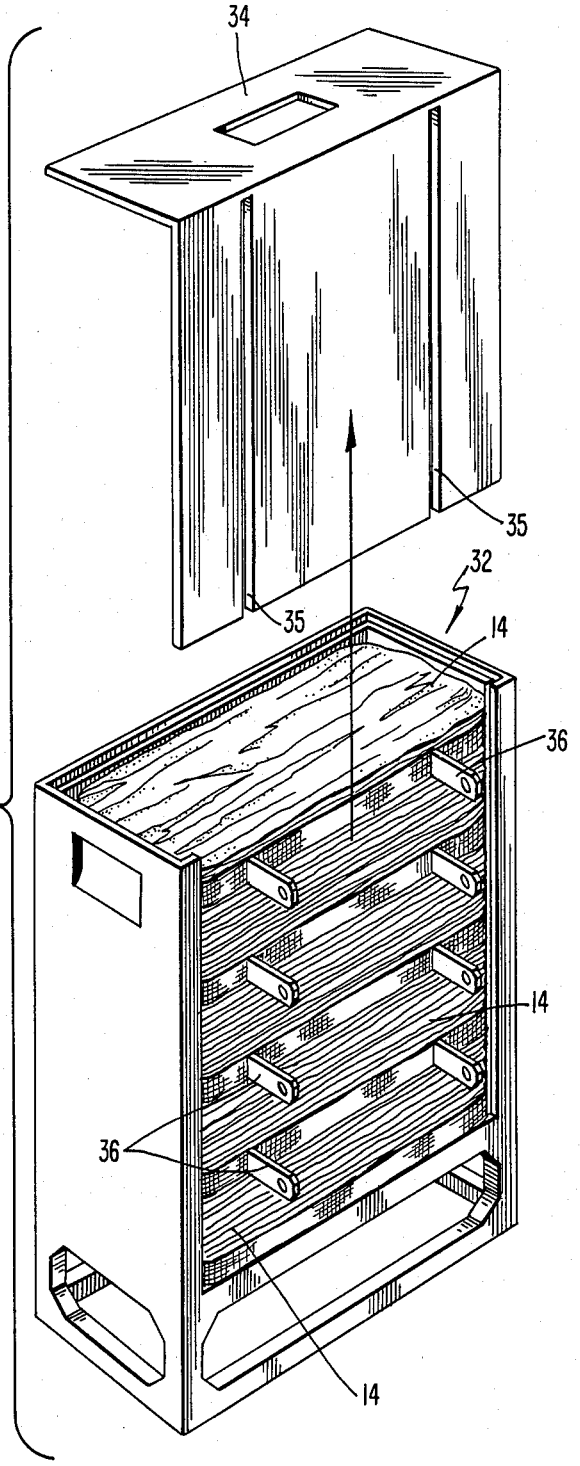
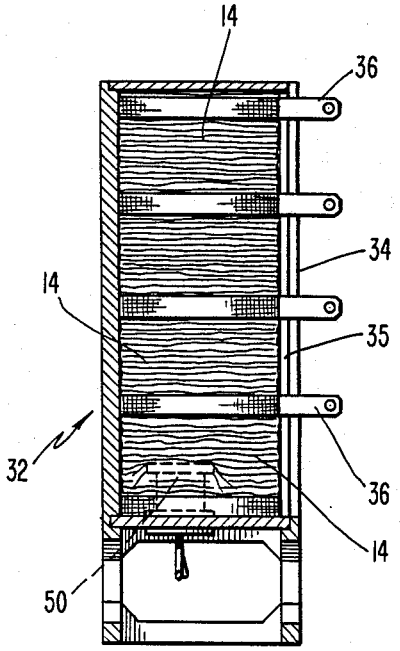
Fig. 10

Fig. 11
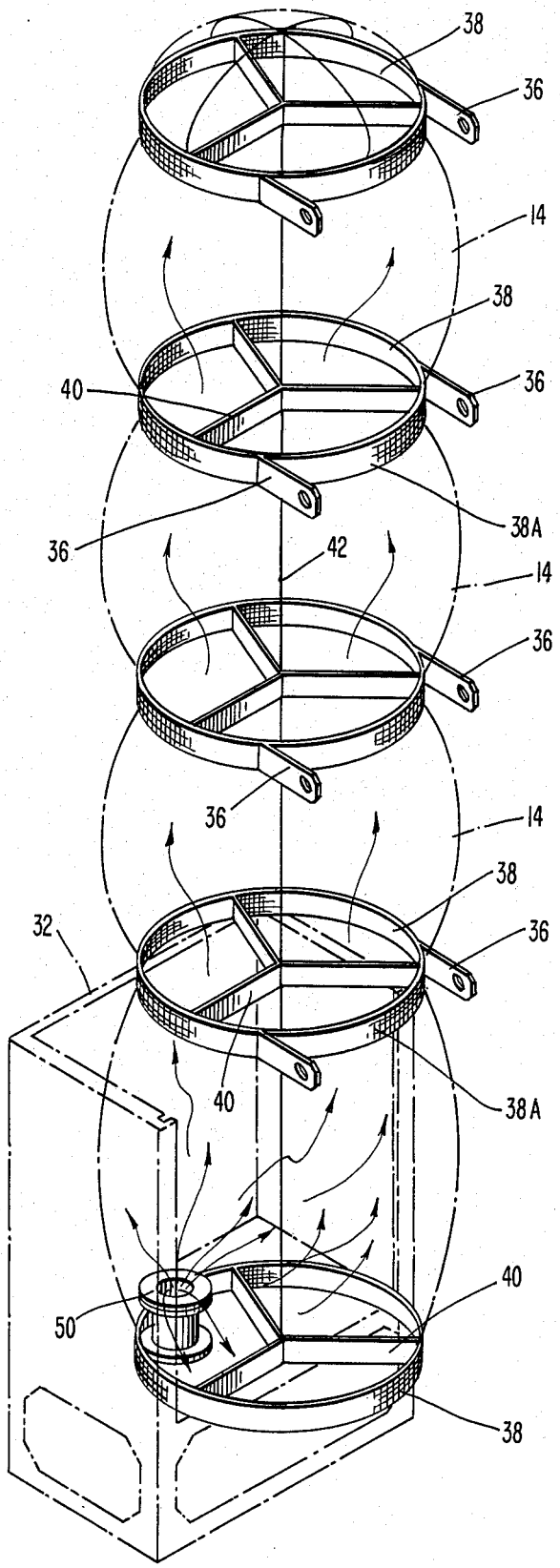
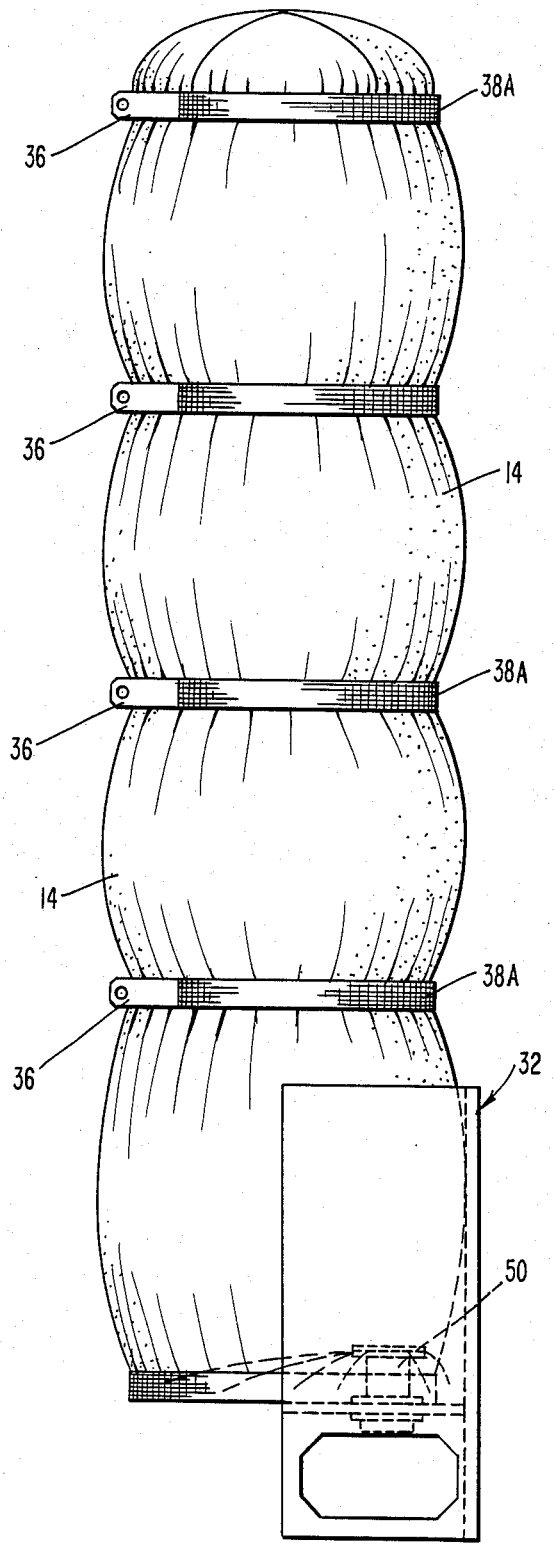
Fig. 12

METHODS AND APPARATUS FOR QUICKLY ERECTING A VEHICLE BARRIER ACROSS A ROADWAY

BACKGROUND OF THE INVENTION

The present invention relates to an instantly erectable access barrier, especially for roadways.

The vulnerability of many buildings, especially those housing government and military personnel to terrorist attacks, is of major concern. Despite the presence of guards and check points, it may be possible for a suicidal terrorist to drive an explosive-laden vehicle past the check point and directly to the building, whereupon a detonation can inflict serious damage to life and property.

It would be possible to position barriers in the roadway, but barriers of sufficient size and strength for resisting a large onrushing truck would be relatively cumbersome to maneuver and would interfere with normal traffic flow.

A terrorist barrier proposed in Terio U.S. Pat. No. 4,576,507 is normally disposed below-ground and intended to be rapidly raised. The barrier comprises a plurality of horizontal cables, the ends of each cable mounted to shock absorbers. The cables and shock absorbers are mounted on I-beams which travel vertically in tracks implanted in the ground. The barrier can be raised by a winch, counterweight system, or explosive means which lifts the I-beams, shock absorbers and cables.

It will be appreciated that a terrorist barrier which is normally disposed below ground must be capable of being raised very rapidly in order to be capable of stopping a quickly advancing vehicle. Therefore, it would be desirable to minimize the overall weight of the risible portion in order to promote a rapid ascent thereof. A barrier in which I-beams and shock absorbers must be raised, may not be capable of sufficiently rapid ascent to be dependable in all situations.

SUMMARY OF THE INVENTION

The above-described shortcomings are overcome by the present invention which relates to a barrier system for resisting the advance of vehicles and the like. The barrier system comprises a barrier mounted in a below-ground chamber, and an energy dissipating mechanism connected to the barrier. The barrier comprises a flexible net, an inflatable bag, and a mechanism for inflating the bag. The net is formed of high-strength material and is attached to the bag. When the bag is inflated, the bag and net are lifted above ground surface into the path of an oncoming vehicle. The energy dissipating mechanism is anchored in the chamber and is connected to opposite ends of the net for permitting limited displacement of the net under the impact of the vehicle while dissipating the energy of the vehicle.

The invention also pertains to the particular structure of the net, bag, and energy dissipating mechanism.

In addition, the present invention pertains to the barrier itself as comprising a flexible net, an inflatable bag, and a mechanism for inflating the bag.

Moreover, the present invention relates to a method of stopping vehicle wherein an inflatable bag is inflated such that the bag extends across a roadway from a folded condition beneath the ground surface. The bag simultaneously raises a net which is connected to the bag, the net having two ends connected to an energy dissipating mechanism. The inflated bag is compressed against impact by the vehicle such that the bag is compressed between the net and the vehicle to impose a first stage speed deceleration on the vehicle. The energy dissipating mechanism yields as the net is displaced by the vehicle, to impose a second stage of deceleration on the vehicle. The net is rendered stationary when the second stage speed deceleration is terminated, to impose a third stage of speed deceleration on the vehicle.

BRIEF DESCRIPTION OF THE DRAWING

The object and advantages of the invention will become apparent from a detailed description of a preferred embodiment thereof in connection with the accompanying drawings, in which like numerals designate like elements, and in which:

FIG. 8 is a perspective view of a housing for carrying a collapsed bag;

FIG. 9 is an exploded perspective view of the housing of FIG. 8;

FIG. 10 is a sectional view taken along the line 10—10 in FIG. 8;

FIG. 11 is a side perspective view of an inflated bag, with the outer layer of the bag depicted in phantom lines; and FIG. 12 is a side elevational view of the inflated bag.

DETAILED DESCRIPTION OF A PREFERRED EMBODIMENT OF THE INVENTION

In accordance with the present invention a vehicle restraint or barrier system is provided which includes a barrier which is normally disposed below ground, but which is capable of being rapidly raised.

Figures 6, 7:
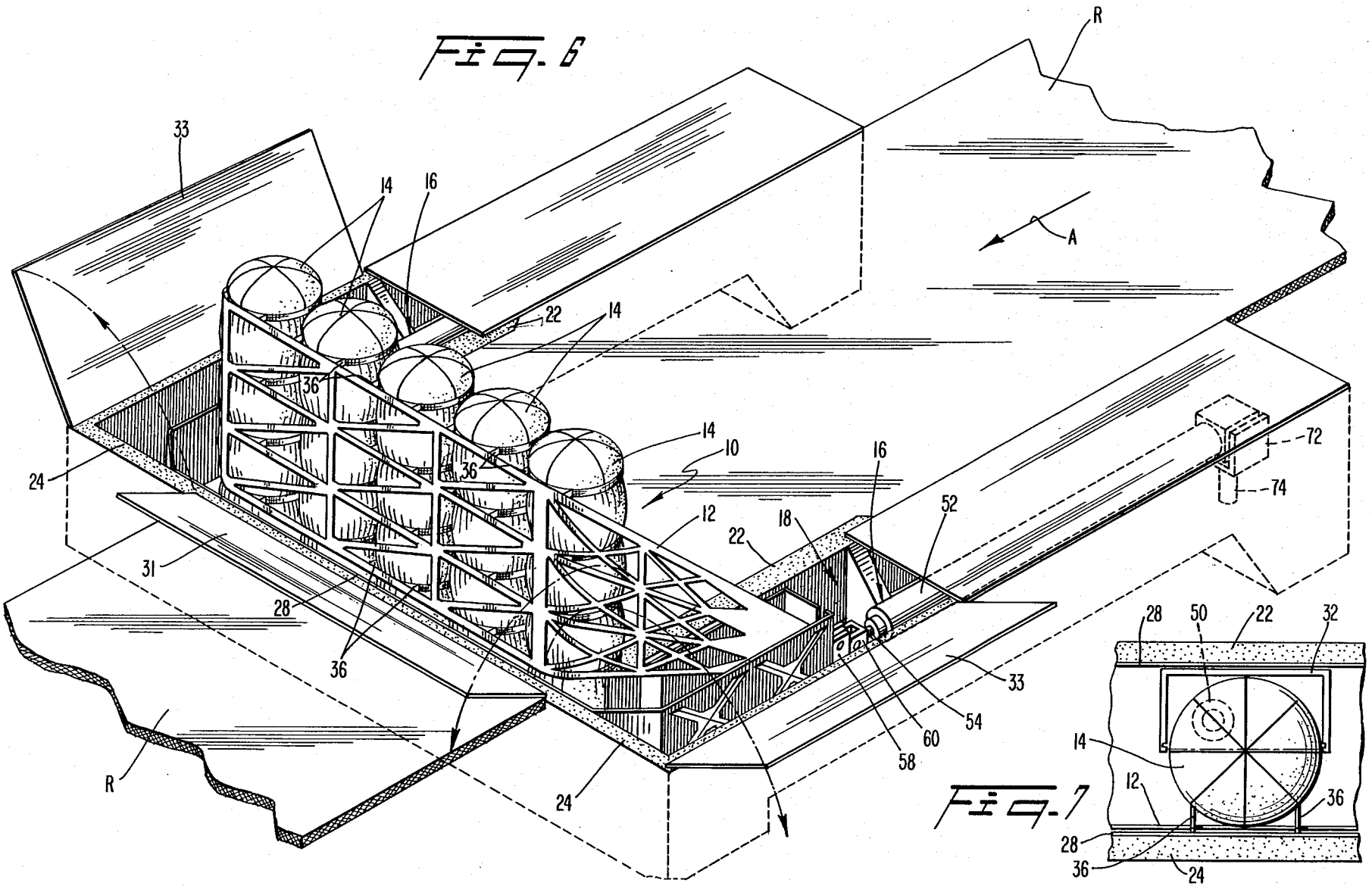
FIG. 6 is a perspective view of the barrier system after being actuated.
FIG. 7 is a top plan view of a bag which has been inflated.

As can be seen in FIG. 6, the barrier system comprises a relatively light weight barrier 10 in the form of a high-strength net 12, a plurality of rapidly inflatable air bags 14 connected to the net, and a pair of energy dissipating units 16 anchored in the ground. Opposite ends of the net are connected to movable portions of the energy dissipating units. As will be explained in detail hereinafter, the air bags 14 are capable of virtually instantaneous inflation to ascend above the ground and pull up the net at the same time. A vehicle striking the barrier 10 will first impact the inflated bags and become progressively slowed in a cushioned manner as the bags collapse. Thereafter, the net will be pushed forwardly in opposition to a yielding resistance of the energy dissipating units. After the considerable speed-reducing cushioning action of the air bags and energy dissipating units has been expended, further advancement of the vehicle will be resisted by the tensile strength of the net.

The net is preferably in the form of a mesh and can be formed of any suitable high modulus material, such as Kevlar TM for example, which is high in tensile strength.

Figure 5:
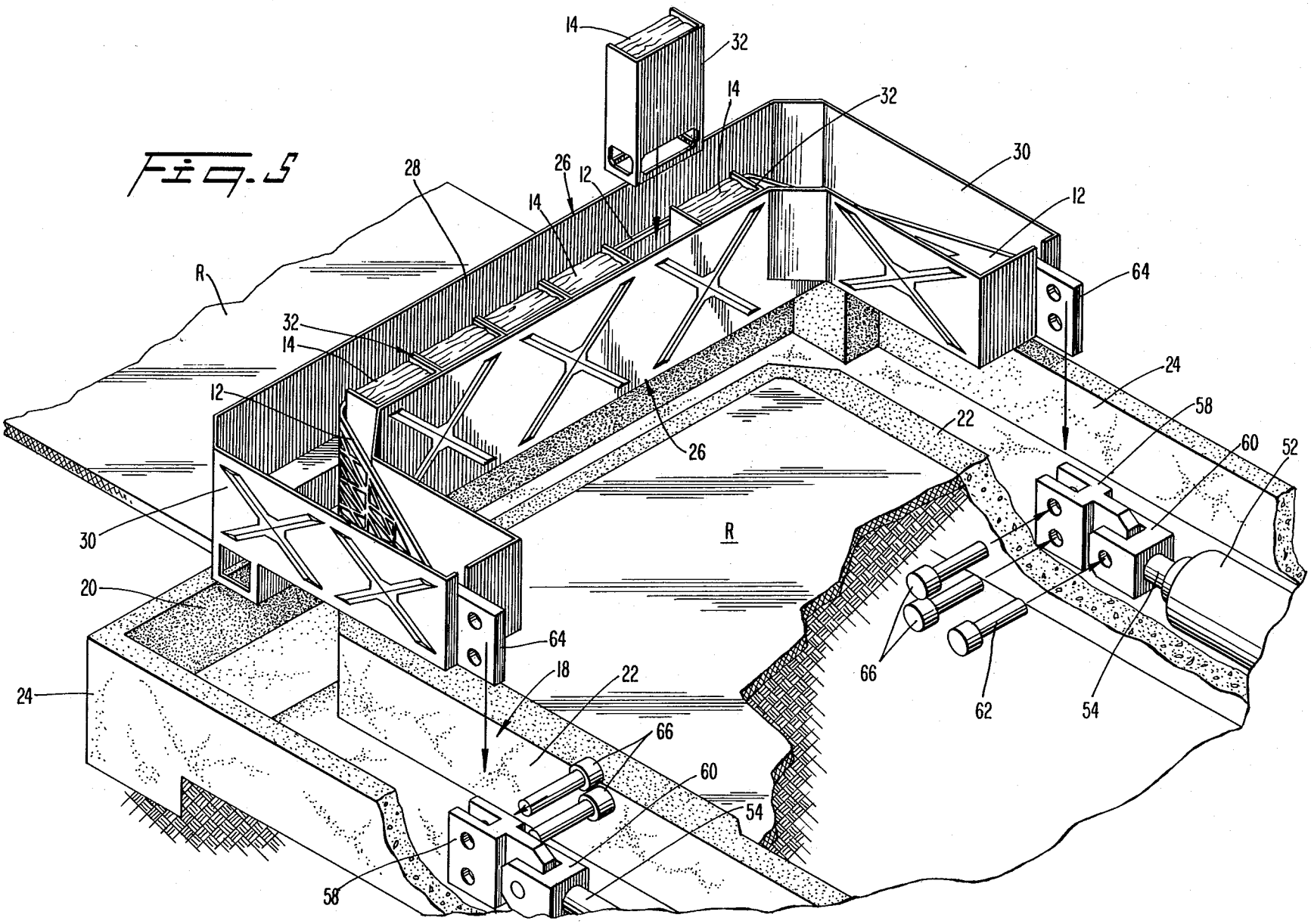
FIG. 5 is an exploded perspective view of the barrier system.

The net and air bags normally reside in a collapsed condition in a subterranean chamber 18. The chamber 18 is U-shaped as viewed in plan (see FIG. 5), comprising a center section 20 and a pair of side sections 22. The chamber is lined with concrete 24, and a housing 26 is disposed in the chamber 18 for containing the net and air bags. The housing 26, which can be formed of any suitable material such as reinforced aluminum, includes a center section 28, and a pair of side sections 30. A plurality of hinged covers 31, 33 are provided over the center and side sections of the chamber, respectively. Those covers are normally in a horizontal closed position but can be pushed open by air bags emerging from the chamber.

The air bags 14 are disposed in a support frame 32 of U-shaped configuration (FIG. 9) and that frame is installed in the subterranean housing 26. A removable door 34 is provided which covers the frame 32 during shipping but is removed when the frame is installed in the housing 26. The bag is formed of any suitable material such as steel cable-reinforced Hypalon TM, for example. When inflated, the bag tends to assume a vertical cylindrical shape as depicted in FIG. 12.

The bag, which can be formed of Hypalon TM, includes a plurality of pairs of connector tabs 36 spaced along the height of the bag to enable the bag to be rigidly connected to the net. The frame door 34 includes slots 35 through which the tabs project. The tabs are connected to internal fabric webbing 38 which extends around the interior periphery of the bag. The bag is vulcanized around the tabs to seal against air leakage.

External webs 38A can be secured around the outside of the bag in addition to, or in lieu of, the internal webs 38. In that case, the tabs would be connected to the external webs.

Strips of metal 40 may be optionally interconnected to each web 38 to define sets of vertically spaced radial spokes which add shaping control to the bag as it is inflated. Those strips are flexible enough to be disposed in a flexed or collapsed condition prior to inflation of the bag. A cable 42 extends from the top set of spokes 40 to the bottom set to limit the height to which the bag can be inflated.

Each bag is provided with a conventional inert gas generator 50 which produces an instantaneous bag inflation. The generators 50 for the various bags 14 are interconnected for simultaneous actuation from a main control station. When the bags inflate, they force open the hinged center cover 31. The inflated bags extend to a height above the ground level sufficient to engage the front end of an oncoming vehicle such as a truck, e.g., to a height of 6 to 8 feet for example. The net 12 is raised along with the bags, thereby forcing open the side covers 33 of the housing as the ends of the net are connected to the deceleration units 16.

Each deceleration unit 16 comprises a cylinder 52 in which a piston (not shown) is slidably mounted. The piston is connected to a rod 54 which extends through one end wall 56 of the cylinder and is connected to an end of the net 12. Preferably, a connector plate 58 is connected to a U-shaped bracket 60 carried by the rod 54 by means of a pin 62. Flanges 64 secured to the end of the net are attached to the plate 58 by a pair of pins 66. The rear end of the cylinder is pivotably mounted by a pivot pin 70 to a trunion 72 which extends into the concrete 24. The pivot pin 7 is horizontally oriented to enable the front end of the cylinder to swing upwardly and downwardly. The trunion 72 is rotatable about a vertical pivot pin 74 to enable the front ends of the cylinders to travel in a horizontal plane if necessary.

In the normal at-rest condition of the energy dissipation units 16, the pistons are held in retracted position relative to the respective cylinder end walls by means of heavy duty coil compression springs (not shown) located within the cylinder. In the event that the net and air bags are raised and impacted by a moving vehicle, the pistons will be pulled toward the end walls at a rate permitted by the strength of those springs. In that fashion, the vehicle momentum will be dissipated and its speed decelerated.

It will be appreciated that in lieu of the use of springs for dissipating the vehicle momentum, the spaces between the pistons and end walls could be filled with fluid, such as air, which is permitted to escape at a controlled rate when the piston is loaded.

Figure 1:
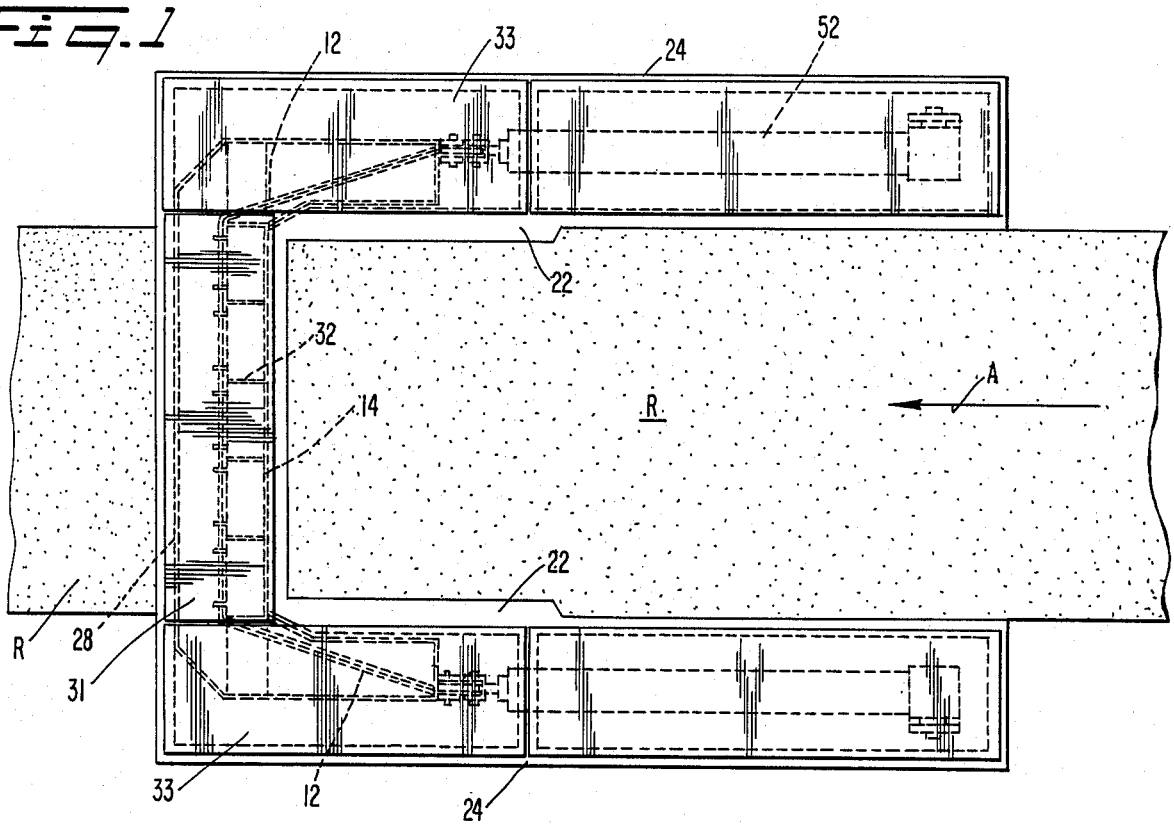
FIG. 1 is a top plan view of a barrier system according to the present invention, when the system is deactivated, permitting vehicles to traverse the roadway.
Figure 3:
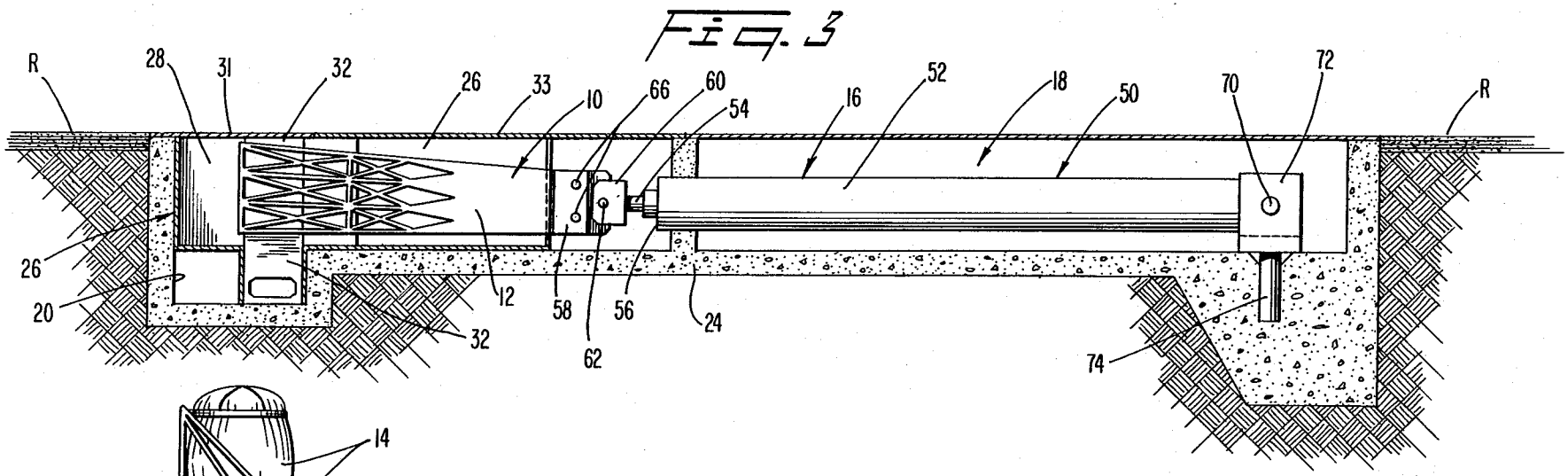
FIG. 3 is a vertical sectional view taken through the barrier system in a deactivated condition.

In operation, the barrier system is normally disposed below ground, concealed by the covers 31, 33 (see FIGS. 1 and 3). At an appropriate moment, the gas generators 50 are actuated to instantaneously inflate the folded-up air bags 14. Actuation may be effected manually by security personnel, or automatically in response to the tripping of a detector or the like.

Figure 2:
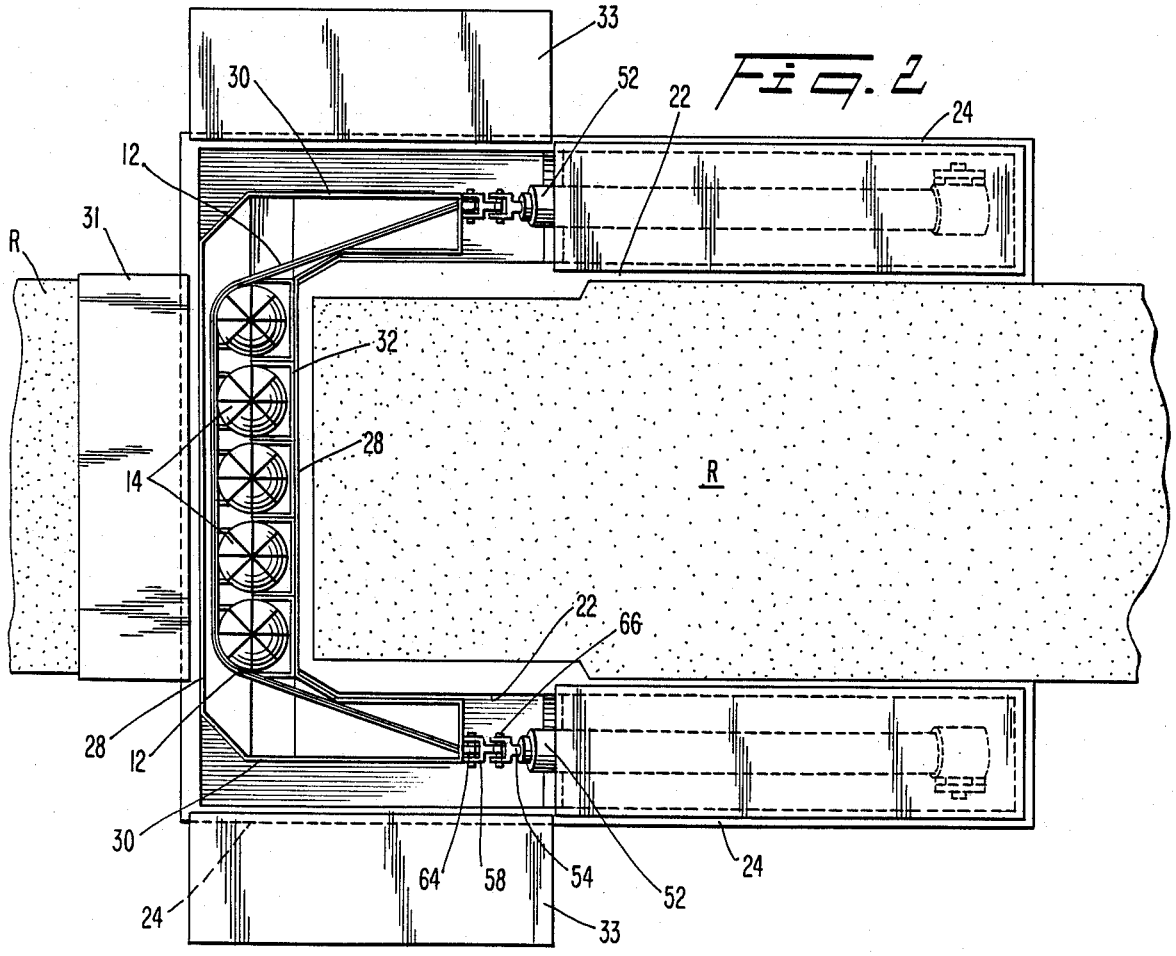
FIG. 2 is a view similar to FIG. 1 after the barrier system has been actuated, and a barrier has been erected above and across the roadway.
Figure 4:
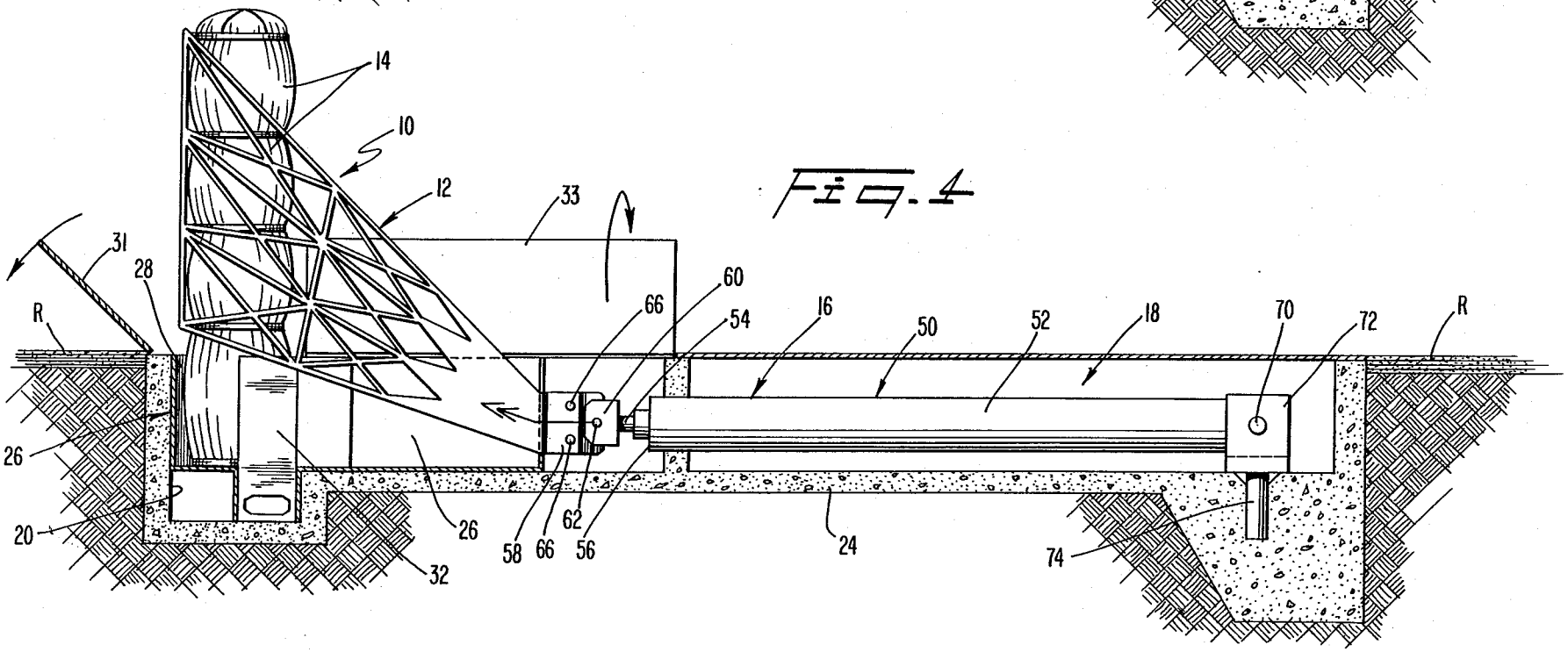
FIG. 4 is a view similar to FIG. 3 after the barrier system has been activated.

When the air bags 14 inflate, they rise above the roadway R and thereby push open the central cover 31. The net 12 is pulled up along with the air bags 14, whereby the roadway is obstructed by the air bags and the net (see FIGS. 2, 4 and 6). Initially, a vehicle traveling in the direction of arrow A will impact and compress the air bags 14, thereby dissipating at least some of the vehicle momentum. If the vehicle momentum is great enough, the air bags 14 will eventually rupture, whereupon the net will be displaced forwardly along with the vehicle, thereby compressing the springs of the energy dissipating units to further dissipate vehicle momentum. In the event that the springs bottom out, any remaining vehicle momentum will be resisted solely by the inherent tensile strength of the net 12. There is thus achieved a three-stage deceleration of the vehicle. Subsequently, the spent net/air bag assembly 12, 14 can be disconnected from the piston rods and replaced by a new net/air bag assembly.

It will be appreciated that the barrier comprised of the net 12 and air bags 14 is relatively light and therefore can be raised at a very rapid rate. Furthermore, the energy utilized to raise the barrier, i.e., the bag-inflating energy is re-utilized since the vehicle must expend energy to deflate the bags. Since the second-stage deceleration units 16 are anchored in the ground, rather than being carried by the barrier, they add no weight to the barrier and can be of large, heavy duty capacity to effect considerable energy dissipation.

Due to the mounting of the cylinders 52 for rotation about horizontal and vertical pivot axes, the barrier 12, 14 can adjust its position to assume various orientations under the influence of the oncoming vehicle, to distribute the loading in a relatively uniform manner and thereby resist the occurrence of force concentrations which might otherwise cause premature breakage of the mechanism.

Although the present invention has been described in connection with a preferred embodiment thereof, it will be appreciated by those skilled in the art that additions, substitutions, modifications and deletions not specifically described, may be made without departing from the spirit and scope of the invention as defined in the appended claims.

What is claimed is:

1. A barrier system for resisting the advance of vehicles and the like, comprising:
   a barrier mounted in a below-ground chamber and including:
      a flexible net formed of high strength material,
      inflatable bag means attached to said net, and
      means for inflating said bag means to raise said bag means and said net above the ground surface into the path of an oncoming vehicle or the like, and
   energy dissipating means anchored in said chamber and connected to opposite ends of said net for permitting limited displacement of said net under the impact of a vehicle while dissipating the energy of said vehicle.

2. Apparatus according to claim 1, wherein said bag means is disposed on a side of said net facing an oncoming vehicle so as to become compressed between the vehicle and said net.

3. Apparatus according to claim 2, wherein said bag means comprises a plurality of air bags connected to said net in horizontally adjacent relationship.

4. Apparatus according to claim 3, wherein each air bag includes cable means therein for limiting the height to which said bags can be inflated.

5. Apparatus according to claim 4 wherein each bag side wall includes vertically spaced tabs for connecting said bag to said net.

6. Apparatus according to claim 1, wherein said energy dissipating means comprises a pair of cylinders, one end of each cylinder being anchored within said chamber, a piston slidable within each cylinder, and a rod connected to each piston and extending through an end wall of its associated cylinder, and yieldable energy absorbing means for yieldably resisting displacement of said piston.

7. Apparatus according to claim 6, wherein an anchored end of each cylinder is mounted for rotation about a horizontal axis oriented perpendicular to said rod.

8. Apparatus according to claim 7, wherein said anchored end is also rotatable about a vertical axis.

9. Apparatus according to claim 6, wherein said yieldable energy absorbing means comprises a coil compression spring situated between said piston and said cylinder end wall.

10. A barrier adapted to be extended across a roadway for resisting the advance of vehicles comprising:
   a flexible net formed of high strength material,
   inflatable bag means connected to said net, and
   means for inflating said bag means to extend said bag means and said net across said roadway.

11. Apparatus according to claim 10, wherein said apparatus further includes energy dissipating means connected to opposite ends of said net.

12. A method of stopping a vehicle comprising the steps of:
   inflating an inflatable bag means such that said bag means extends across a roadway from a folded condition beneath the ground surface, said bag means simultaneously raising a net connected to said bag means, said net having two ends connected to energy dissipating means,
   causing said inflated bag means to be compressed upon impact by said vehicle such that said bag means is compressed between said net and vehicle to impose a first-stage speed deceleration on said vehicle,
   causing said energy dissipating means to yield as said net is displaced by the vehicle, to impose a second-stage speed deceleration on the vehicle, and
   imposing non-yieldable forces on said net rendering said net stationary after said second-stage speed deceleration is terminated, to impose a third-stage speed deceleration on said vehicle.

13. Apparatus according to claim 1, wherein said inflatable bag means comprises a plurality of spaced apart inflatable bags, said net being operably connected at vertically spaced locations along side walls of said bags such that said side walls support said net in a raised condition when said bags are in an inflated condition.

14. Apparatus according to claim 10, wherein said inflatable gab means comprises a plurality of spaced apart inflatable bags, said net being operably connected at vertically spaced locations along side walls of said bags such that said side walls support said net in a raised condition when said bags are in a inflated condition.

* * * * *